US012185808B2

(12) United States Patent
Crook et al.

(10) Patent No.: US 12,185,808 B2
(45) Date of Patent: Jan. 7, 2025

(54) USER RECONFIGURABLE HANDBAGS

(71) Applicants: Penny Loraine Crook, Loudon, TN (US); Marshall Keith Crook, Loudon, TN (US)

(72) Inventors: Penny Loraine Crook, Loudon, TN (US); Marshall Keith Crook, Loudon, TN (US)

( * ) Notice: Subject to any disclaimer, the term of this patent is extended or adjusted under 35 U.S.C. 154(b) by 37 days.

(21) Appl. No.: 18/059,421

(22) Filed: Nov. 28, 2022

(65) Prior Publication Data

US 2023/0165346 A1 Jun. 1, 2023

Related U.S. Application Data

(60) Provisional application No. 63/283,745, filed on Nov. 29, 2021.

(51) Int. Cl.
*A45C 3/06* (2006.01)
*A45C 13/10* (2006.01)

(52) U.S. Cl.
CPC ..... *A45C 3/06* (2013.01); *A45C 13/103* (2013.01); *A45C 13/1069* (2013.01)

(58) Field of Classification Search
CPC ..... A45C 3/06; A45C 13/103; A45C 13/1069
See application file for complete search history.

(56) References Cited

U.S. PATENT DOCUMENTS

| | | | | |
|---|---|---|---|---|
| 2,423,889 | A * | 7/1947 | Hurt | A45C 11/22 383/85 |
| 2,898,524 | A * | 8/1959 | Stamberger | H01F 7/18 335/282 |
| 3,025,093 | A * | 3/1962 | Millman | A45C 13/126 24/593.1 |
| 6,672,439 | B2 * | 1/2004 | Platte, III | A45C 3/02 190/103 |
| 2013/0180636 | A1 * | 7/2013 | Ashley | A45C 13/00 150/118 |

* cited by examiner

*Primary Examiner* — Tri M Mai
(74) *Attorney, Agent, or Firm* — Daniel Maffeo

(57) ABSTRACT

The present invention relates to a user configurable bag having a main body, a reversible bag flap and a fastening mechanism. The main body includes a first side panel, a first bottom panel, a second bottom panel and a second side panel. The reversible bag flap includes a leading section, a middle section, a bottom section and an end section. The bag flap has a first orientation and a second orientation, wherein an initially inside-facing surface of the bag flap in the first orientation transitions to become an outside-facing surface in the second orientation, thereby enabling the user to dramatically alter the external appearance of the bag at will.

10 Claims, 23 Drawing Sheets

Top View

FIG. 4A
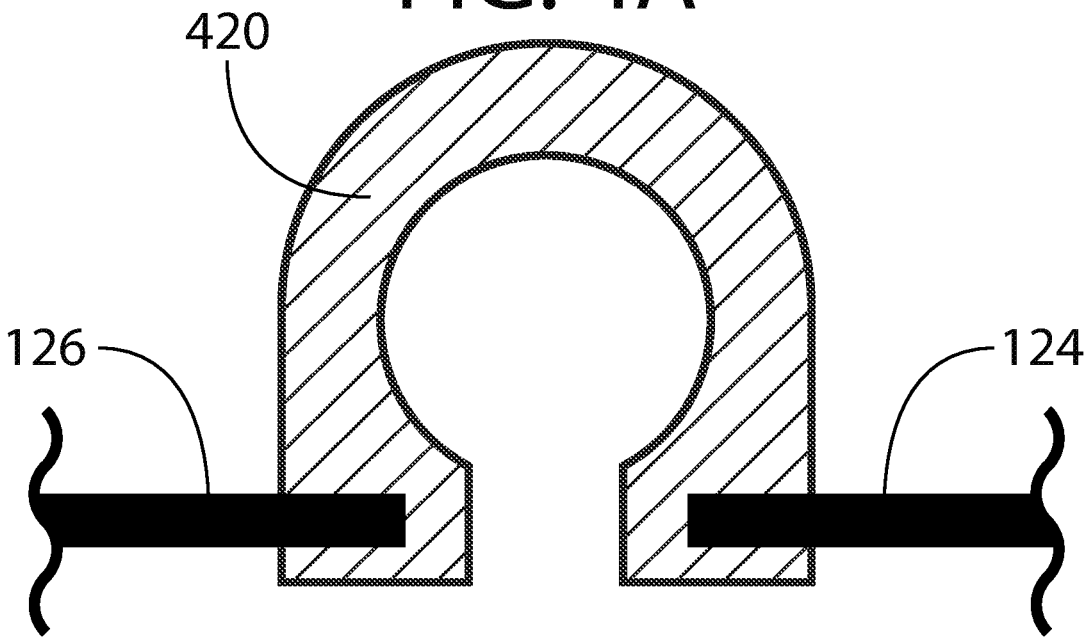
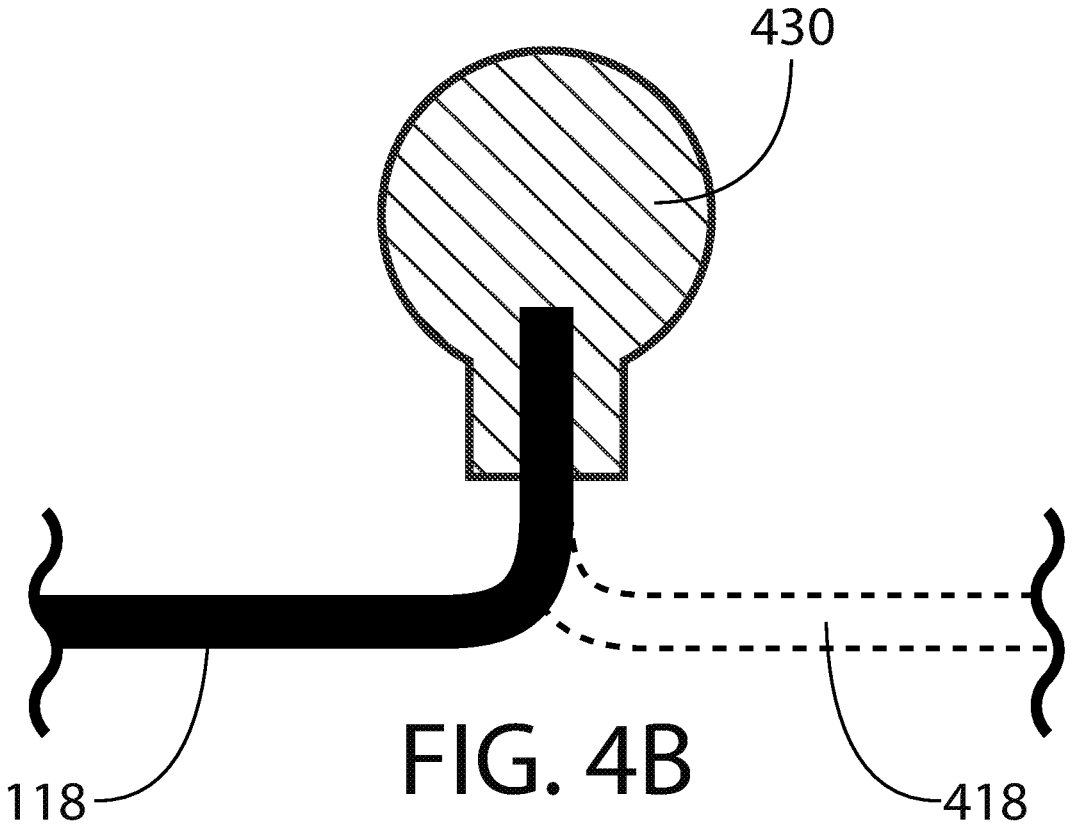
FIG. 4B

USER RECONFIGURABLE HANDBAGS

CROSS REFERENCE TO RELATED APPLICATION

This U.S. non-provisional application claims the benefit and priority of U.S. provisional application No. 63/283,745, filed Nov. 29, 2021, which all applications are incorporated herein in their entirety by this reference.

BACKGROUND

The present invention relates to systems and methods for designing and manufacturing highly configurable utility bags, and more specifically, user-configurable ladies' handbags and purses.

Handbags have for many years served as both utility containers and often as fashion statements. Many users, especially those with active and/or highly visible lifestyles, have a need to accessorize and re-accessorize in real time, for example, when "on the road" such as during a business trip and/or a leisure trip.

In addition, for many urban dwellers, especially residents of high-rise apartments or condominiums, storage space is a premium. Hence the ability for users to be able to re-configure bags at will, is an extremely desirable feature.

It is therefore apparent that an urgent need exists for inspirational concepts of highly functional and user reconfigurable bags. These improved concepts will enable designers and manufacturers to provide users with reconfigurable, fashionable and desirable bags that also take up minimal space at optimal costs.

SUMMARY

To achieve the foregoing and in accordance with the present invention, systems and methods for designing and manufacturing highly configurable utility bags is provided. In particular, designers can be inspired to adopt these systems and methods to produce user-configurable ladies' handbags and purses.

In one embodiment, a user configurable bag has a main body, a reversible bag flap and a fastening mechanism. The main body includes a first side panel, a first bottom panel, a second bottom panel and a second side panel. The reversible bag flap includes a leading section, a middle section, a bottom section and an end section. The bag flap has a first orientation and a second orientation, wherein an initially inside-facing surface of the bag flap in the first orientation transitions to become an outside-facing surface in the second orientation. The fastening mechanism of the bag includes a reversible flap portion, a first body portion and a second body portion. Depending on the orientation of the flap, the flap portion of this mechanism mates with either the first body portion attached to the first side panel or to the second body portion attached to the second side panel.

In some embodiments, the bag also includes a flap stabilizing mechanism for securing the middle section of the flap to the main body of the bag. The stabilizing mechanism can be a short strap with a flap module, e.g., a dual-faced magnetic button, configured to be coupled to one or more corresponding body module(s).

In some embodiments, the main body of the bag includes a closing mechanism, e.g., a zipper, for securing the top of the first side panel to the top of the second side panel. The bag may have a detachable carrying strap or a permanently attached carrying strap.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, some embodiments will now be described, by way of example, with reference to the accompanying drawings, in which:

FIGS. 4A-4D illustrate another embodiment of a user-configurable bag with a reversible and user-replaceable flap, in accordance with the present invention;

DETAILED DESCRIPTION

The present invention will now be described in detail with reference to several embodiments thereof as illustrated in the accompanying drawings. In the following description, numerous specific details are set forth in order to provide a thorough understanding of embodiments of the present invention. It will be apparent, however, to one skilled in the art, that embodiments may be practiced without some or all of these specific details. In other instances, well known process steps and/or structures have not been described in detail in order to not unnecessarily obscure the present invention. The features and advantages of embodiments may be better understood with reference to the drawings and discussions that follow.

Aspects, features and advantages of exemplary embodiments of the present invention will become better understood with regard to the following description in connection with the accompanying drawing(s). It should be apparent to those skilled in the art that the described embodiments of the present invention provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present invention as defined herein and equivalents thereto. Hence, use of absolute and/or sequential terms, such as, for example, "always," "will," "will not," "shall," "shall not," "must," "must not," "first," "initially," "next," "subsequently," "before," "after," "lastly," and "finally," are not meant to limit the scope of the present invention as the embodiments disclosed herein are merely exemplary.

The present invention relates to systems and methods for highly reconfigurable carrying bags, and more specifically, user-configurable ladies' handbags and purses.

Figure 1A:
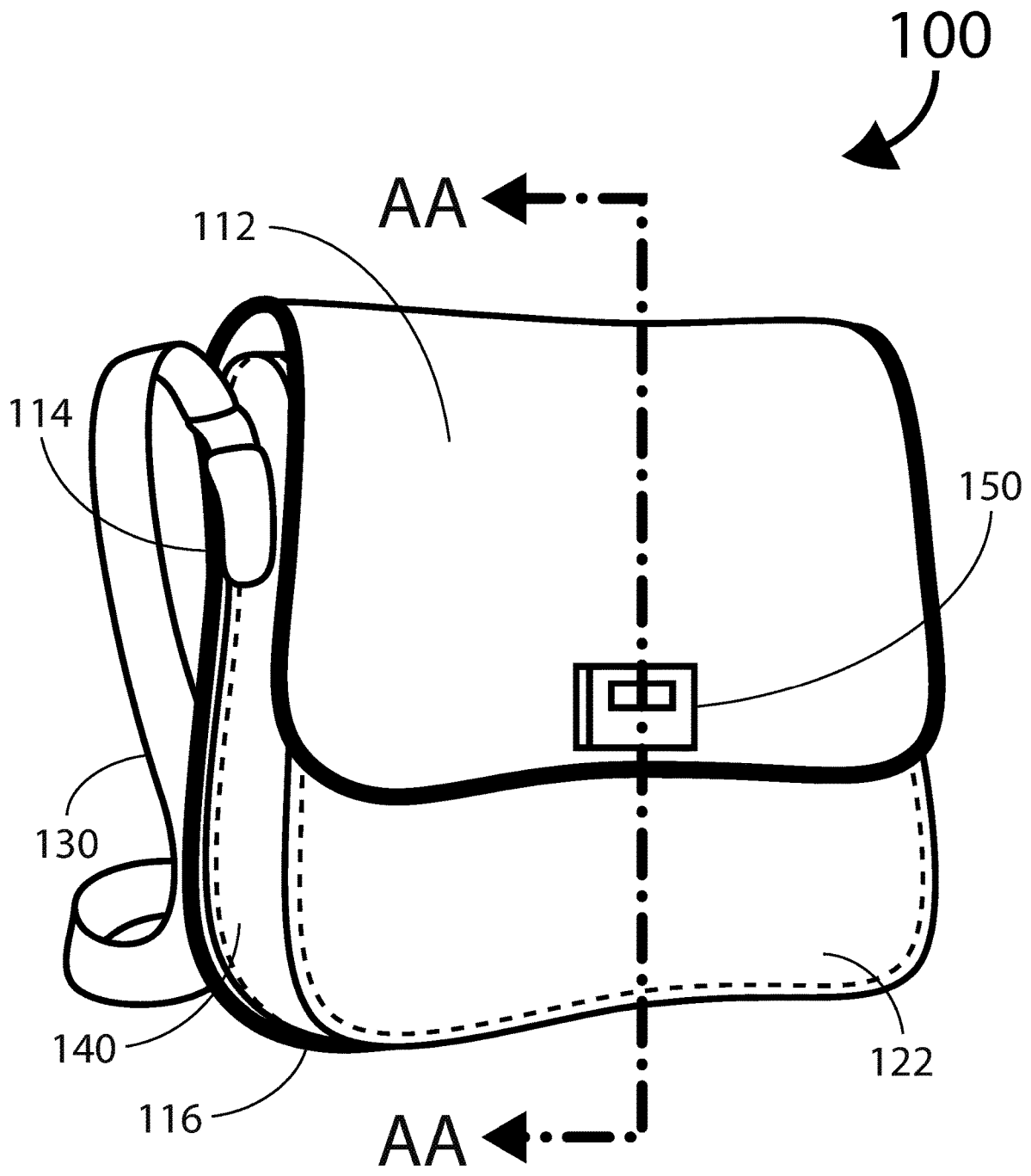
FIG. 1A is a perspective view of a user configurable bag with a reversible flap, in accordance with one embodiment of the present invention.
Figure 1B:
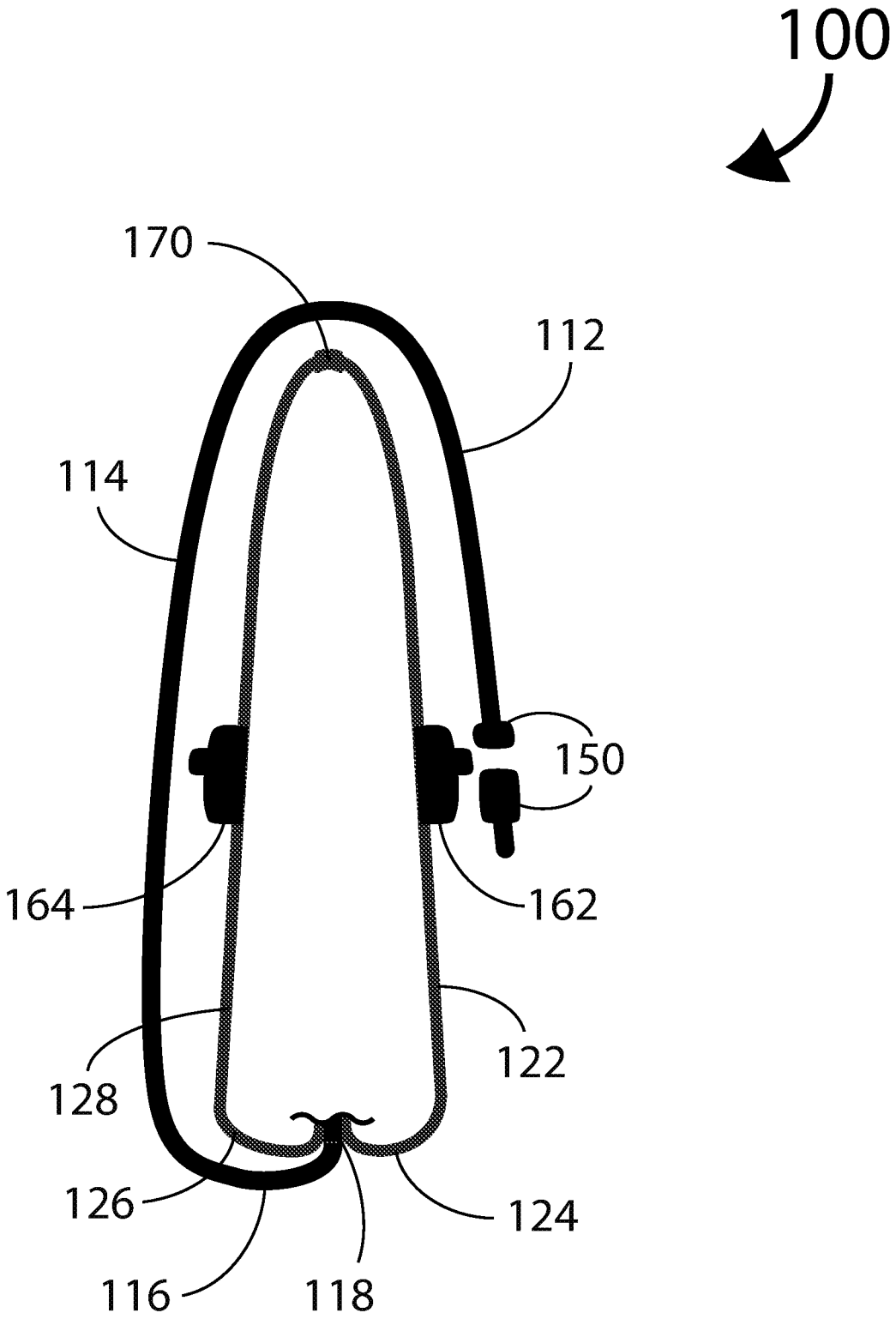
FIG. 1B is a cross-sectional view AA-AA of FIG. 1A, depicting the components and also illustrating the functionality of such a bag.

To facilitate discussion, FIG. 1A is a perspective view of a user-configurable bag 100 with a reversible flap, in accordance with one embodiment of the present invention. FIG. 1B is a cross-sectional view AA-AA of FIG. 1A, depicting the components of and also illustrating the functionality of bag 100.

The reversible flap of bag 100, e.g., a handbag, includes a leading section 112, a middle section 114, a bottom section 116 and an end section 118. Bag 100 includes a main body with a first side panel 122, a first bottom panel 124, a second bottom panel 126, a second side panel 128, and a closing mechanism 170, such as a zipper. Bag 100 also includes a fastening mechanism with a reversible flap portion 150, a first body portion 162 and a second body portion 164. An optional strap 130 such as a shoulder strap can be either permanently attached or can be detachable (see bag variant of FIG. 1C with a D-ring for attaching such a detachable strap).

The end section 118 of the flap is securely sandwiched in between the first bottom panel 124 and the second bottom panel 126. In some embodiments, depending on the respective materials used for construction of bag 100, the end section 118 can be securely fastened to the bottom panels 124, 126 by suitable joinery technique(s) including stitching, adhesive(s), heat bonding and/or ultrasonic bonding.

FIGS. 2A-2F shows a gradual progressive transition of the flap of bag 100 during its orientational reversal process, wherein an initially inside-facing surface of the flap becomes the outside-facing surface and vice versa. By reversing the flap orientation of bag 100, the external appearance of bag 100 can be advantageously and dramatically morphed, and bag 100 looks like a very different bag.

Figure 2A:
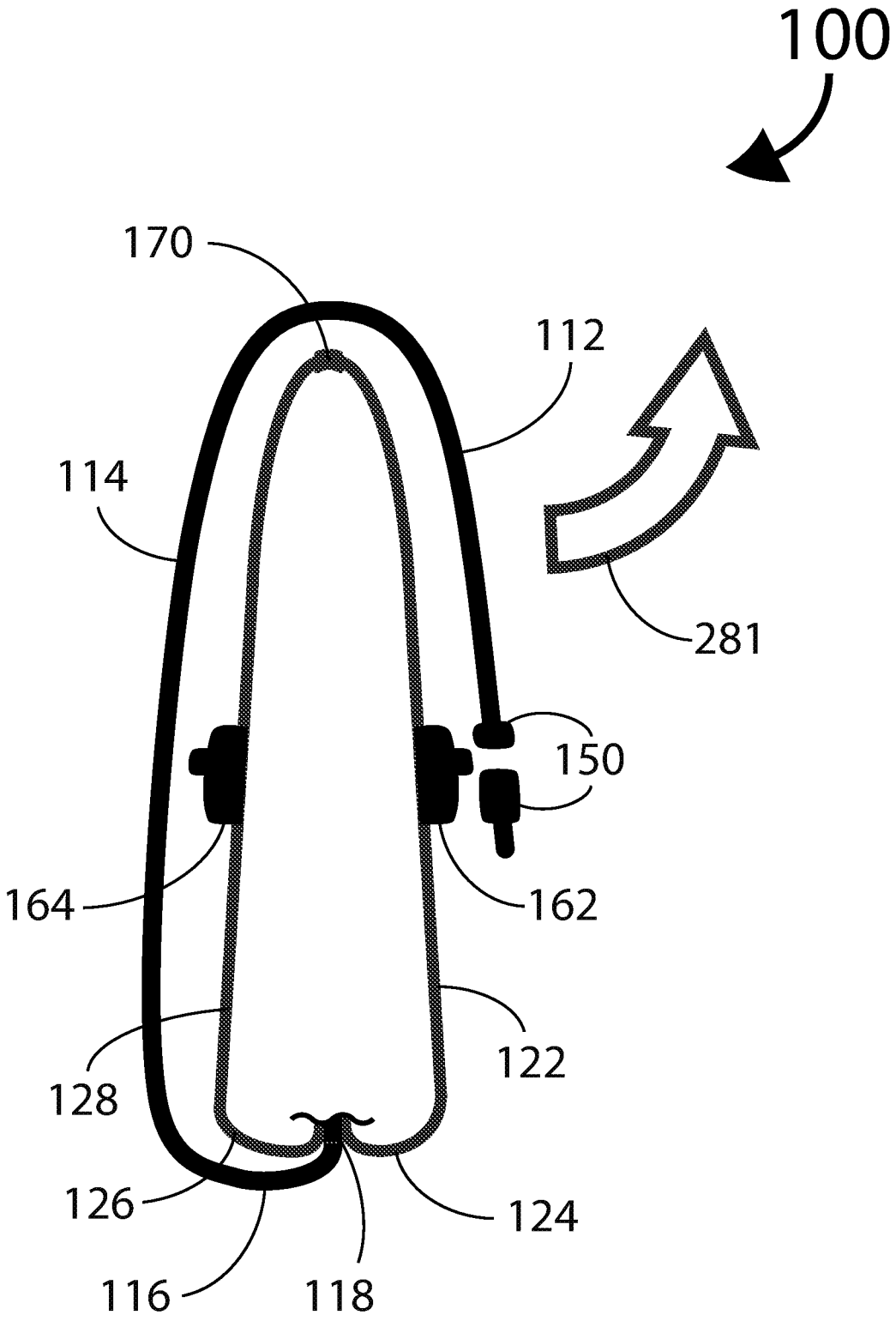
FIGS. 2A-2F shows a gradual progressive transition of the flap of the bag of FIG. 1B during its orientation reversal process, wherein an initially inside-facing surface of the flap becomes the outside-facing surface and vice versa, thereby dramatically morphing the external appearance of bag.

Referring first to FIG. 2A, the flap of bag 100 is in an initial orientation, with flap portion 150 of the fastening mechanism aligned to and positioned to engage with first body portion 162 of the fastening mechanism. As indicated by curved directional arrow 281, the leading section 112 of the flap rotates away from the first side panel 122, thereby disengaging the flap portion 150 from the first body portion 162 of the fastening mechanism.

Figure 2B:
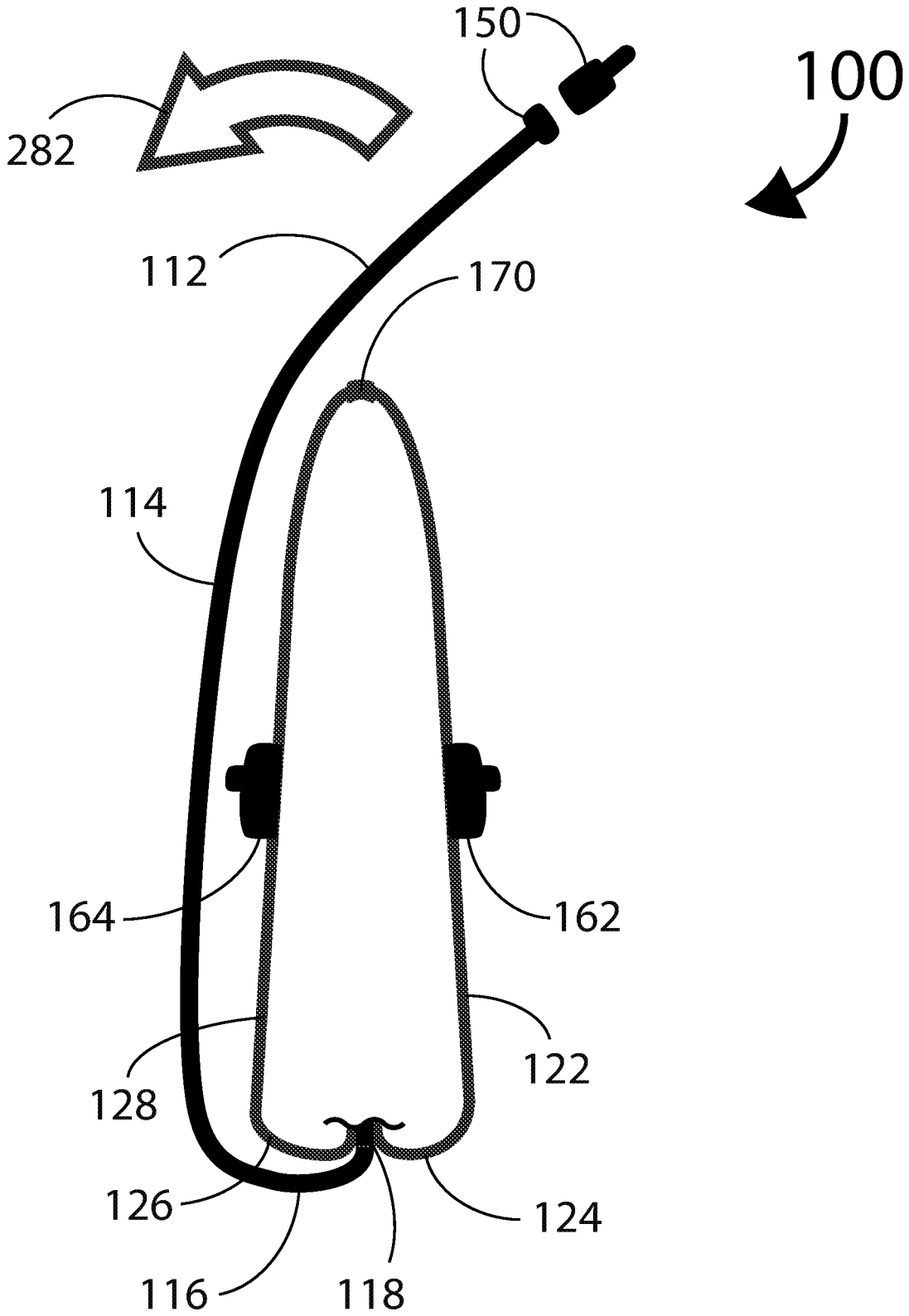
Figure 2C:
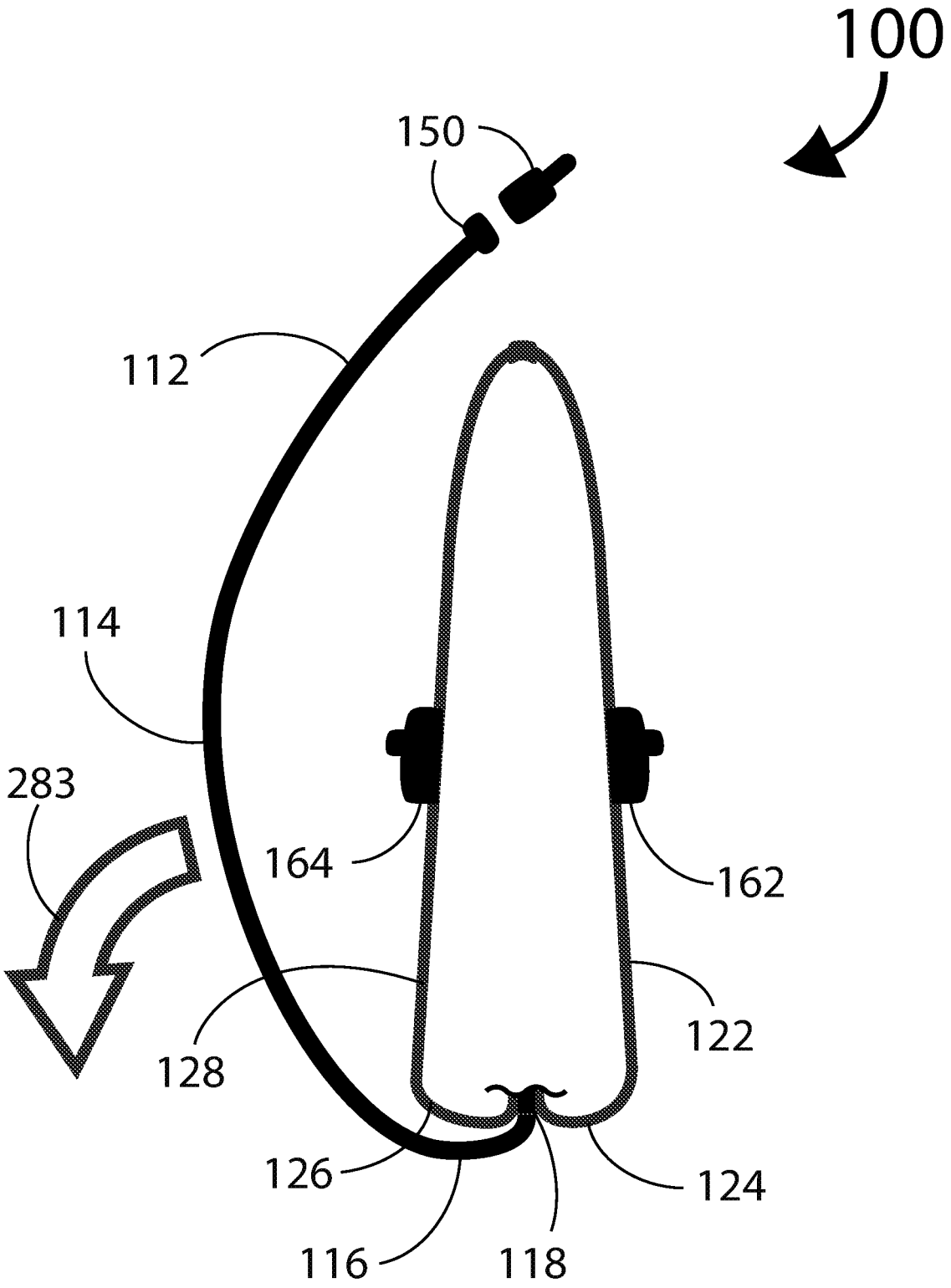
Figure 2D:
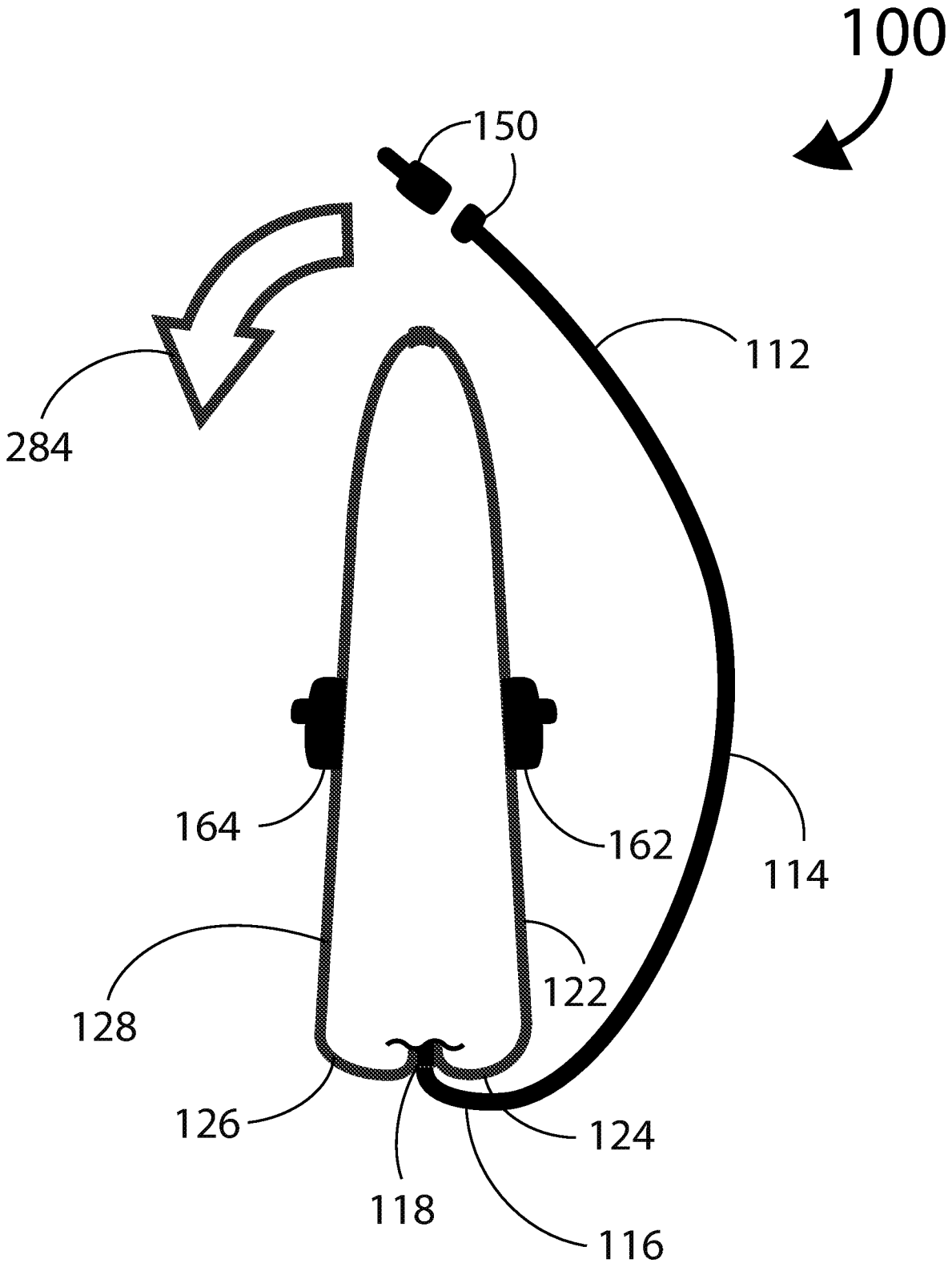

As shown in FIGS. 2B & 2C and as indicated by respective curved directional arrows 282 & 283, the leading section 112 followed by the middle section 114 of the flap continue to rotate away from the main body of bag 100. As the orientational reversal process progresses, eventually the middle section 114 of the flap flips over and repositions itself from being adjacent to the second body panel 128 to being adjacent to the first body panel 122, as illustrated by FIG. 2D.

Figure 2E:
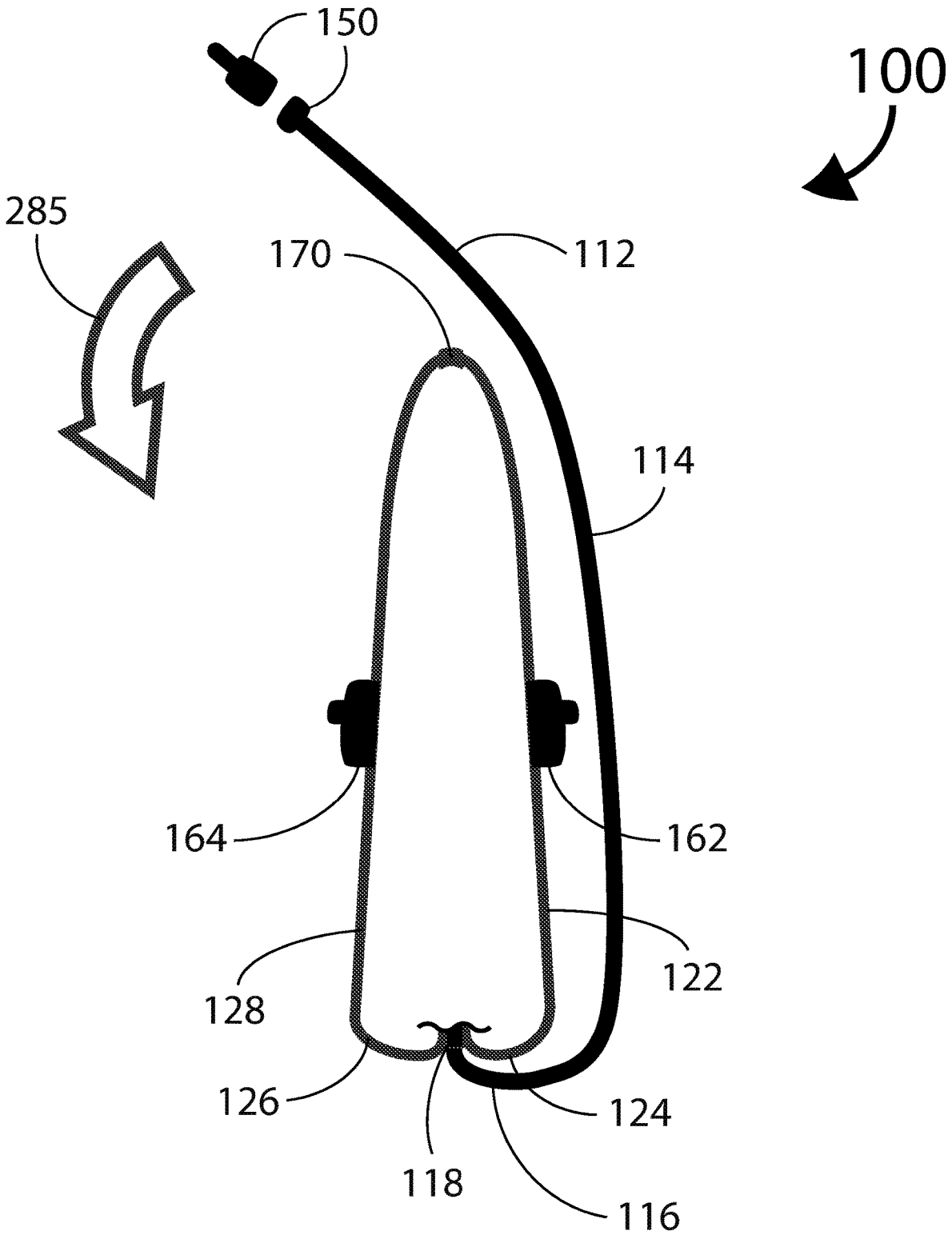
Figure 2F:
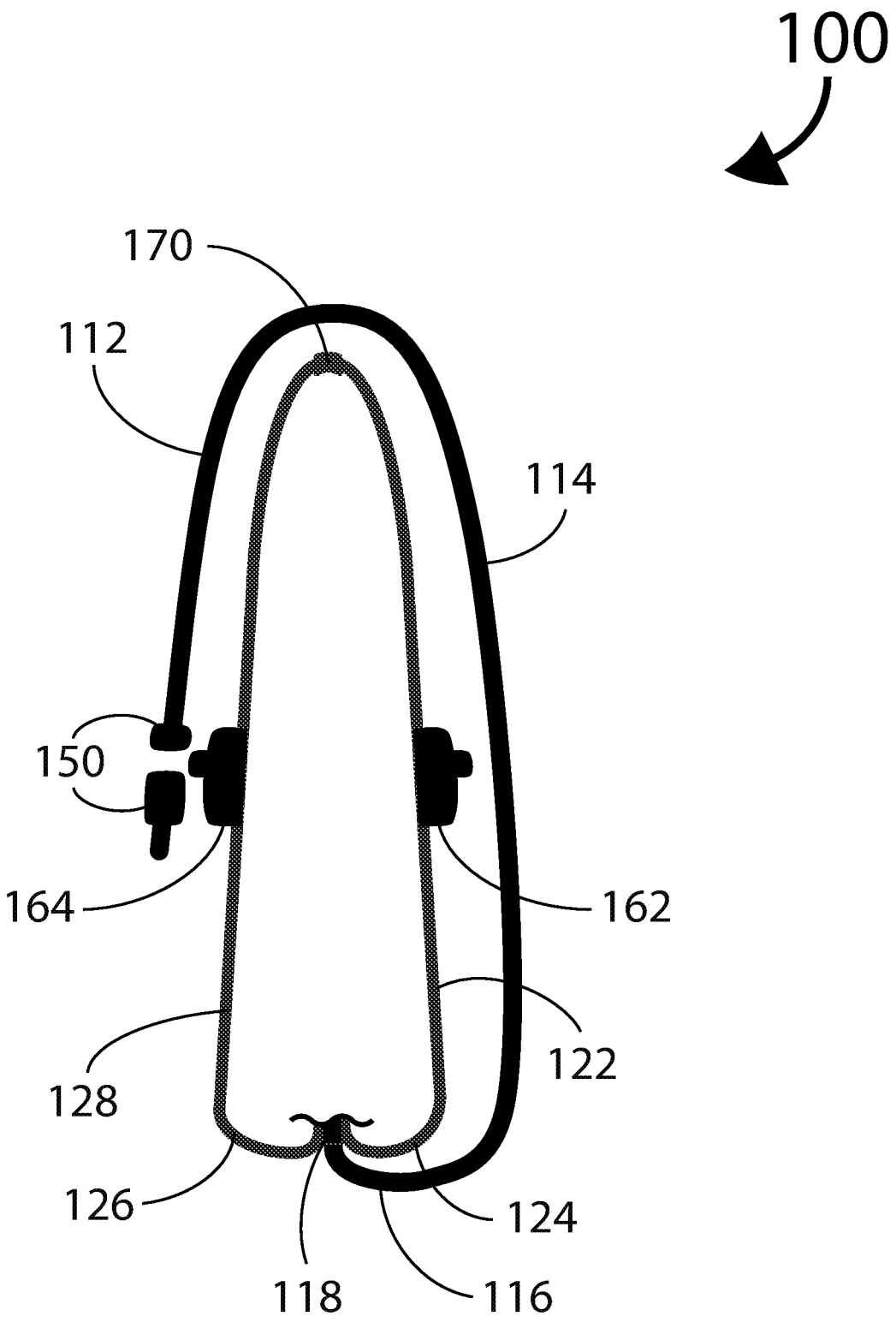

Finally, as illustrated by FIGS. 2E & 2F and as indicated by curved directional arrow 285, the leading section 112 of the flap ends up repositioning itself to being adjacent to the second body panel 128. In addition, the reversible flap portion 150 of the fastening mechanism is now aligned to and positioned to engage with second body portion 164 of the fastening mechanism.

Figure 3A:
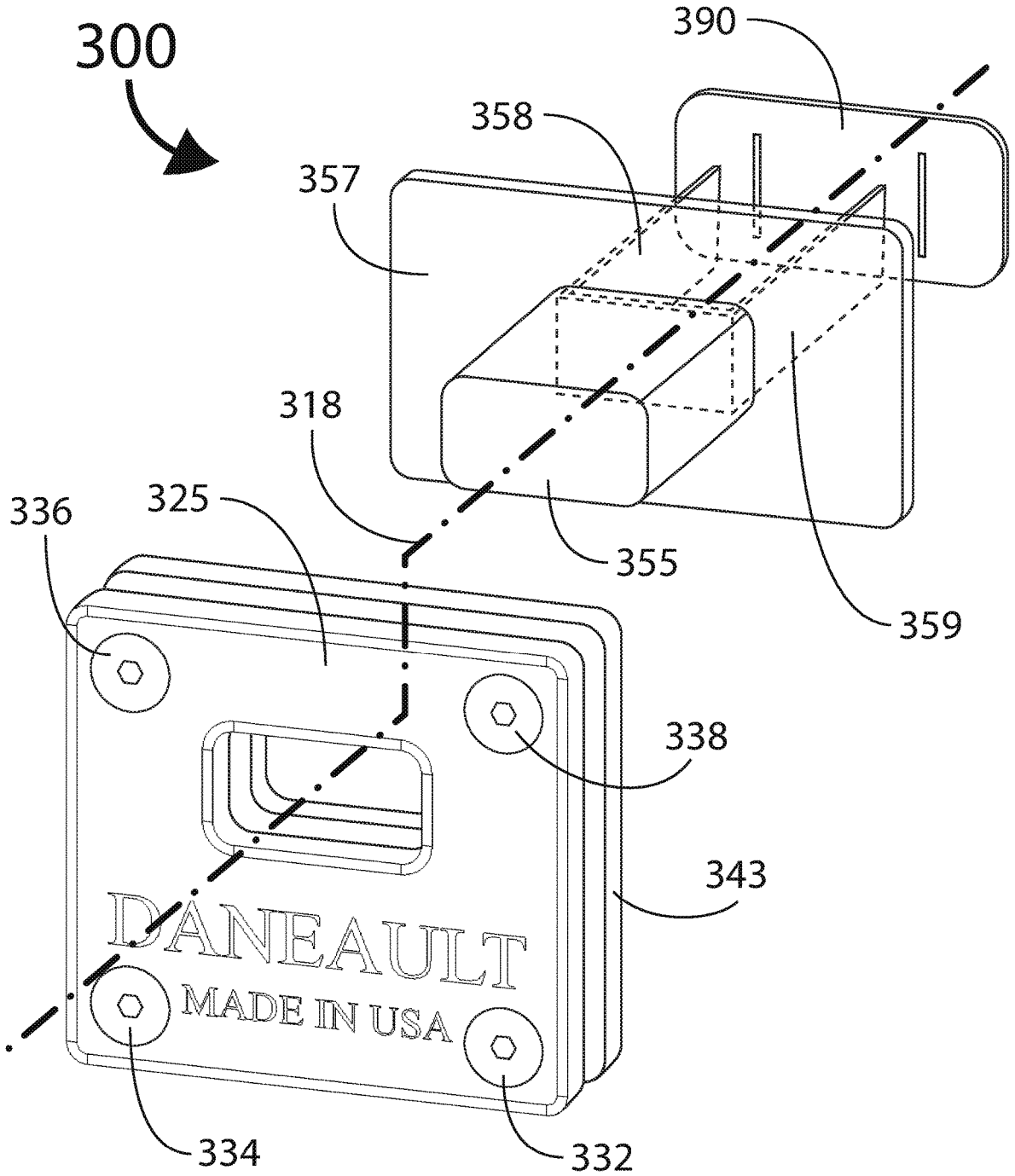
FIG. 3A is a perspective view of an exemplary fastening mechanism for the user configurable bag of FIG. 1A.
Figure 3B:
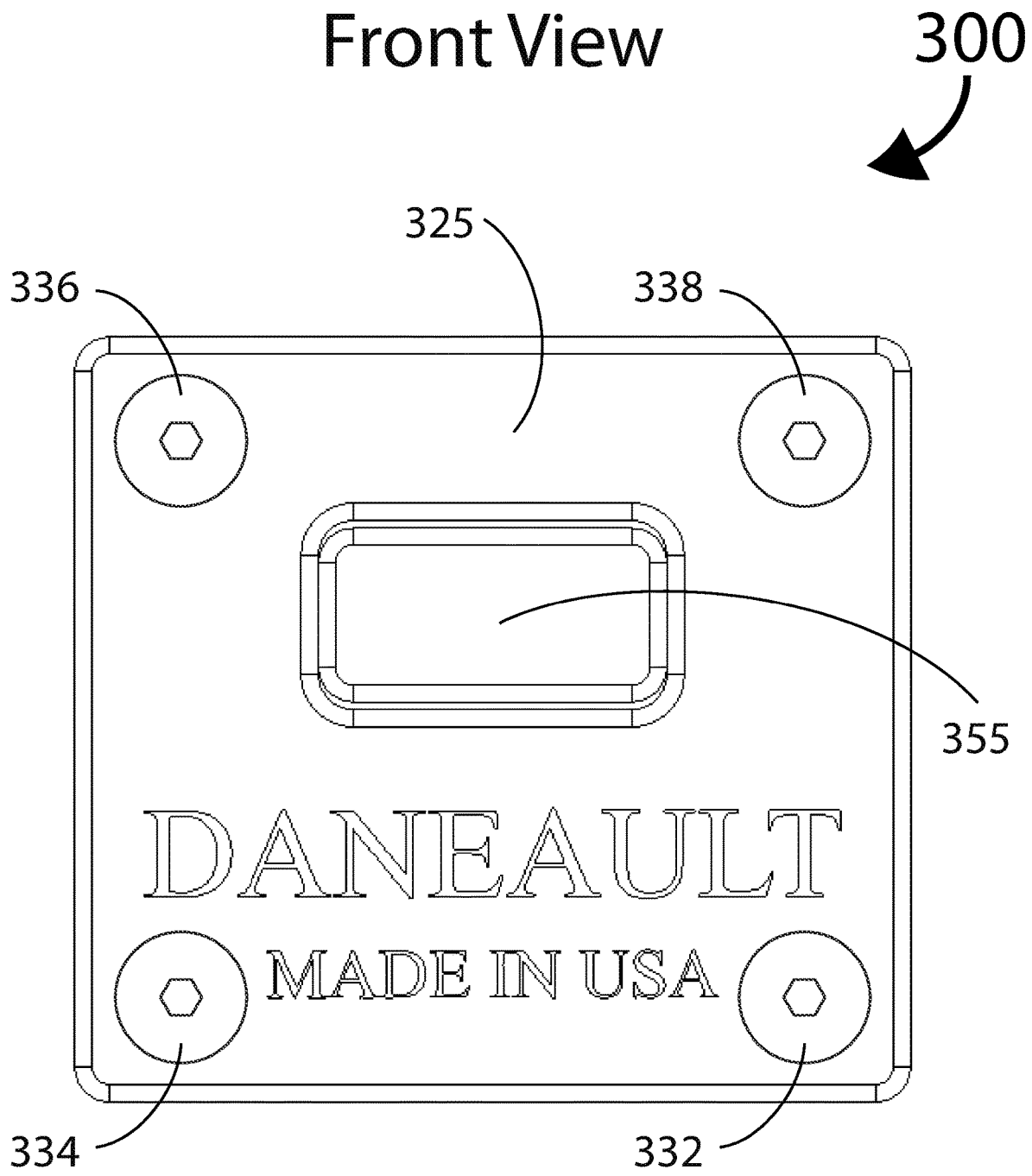
FIGS. 3B and 3C are front and side views, respectively, depicting the various components of the fastening mechanism of FIG. 3A.
Figure 3C:
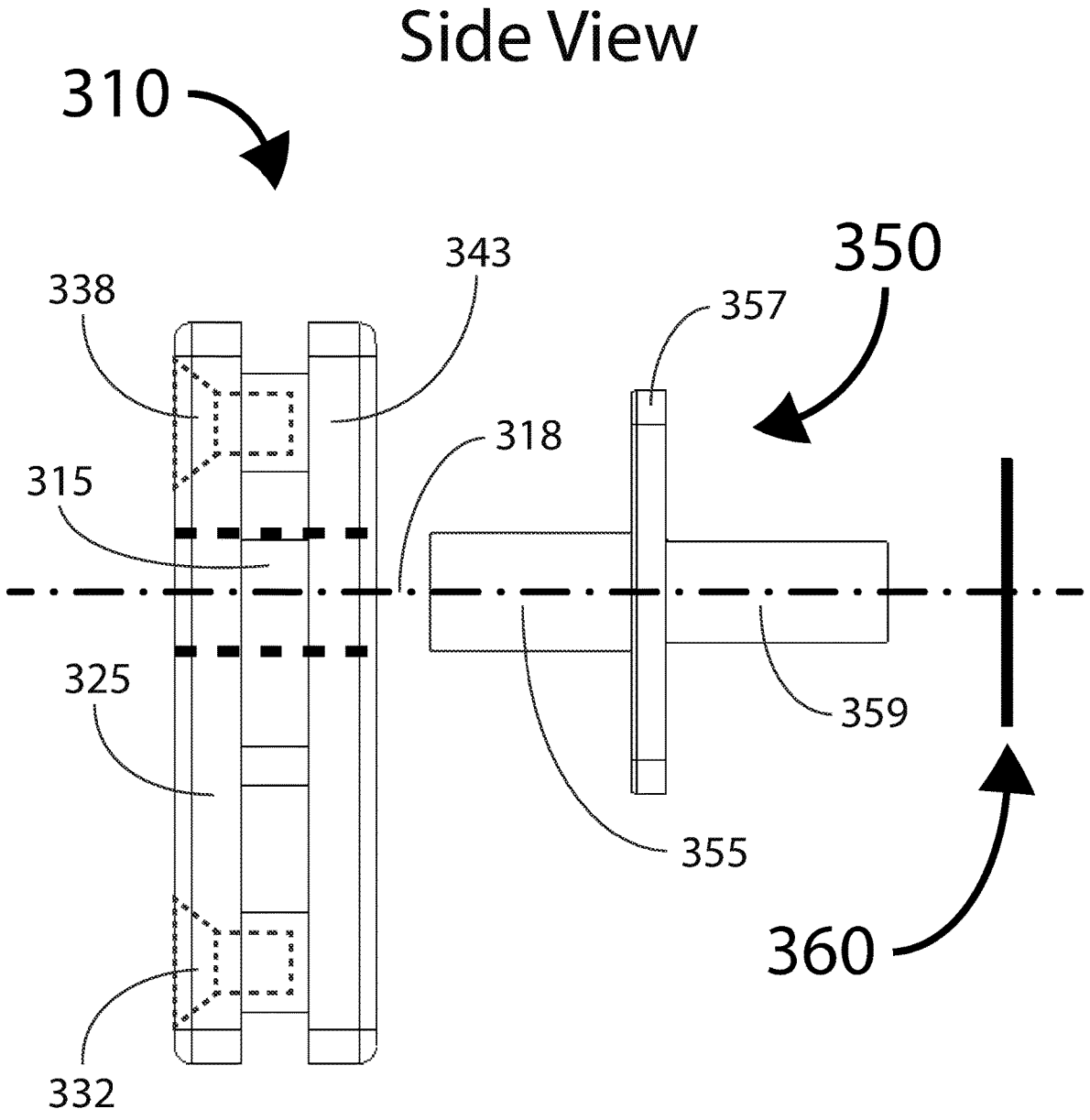

FIG. 3A is a perspective view of a suitable exemplary fastening mechanism 300 for the user-configurable bag 100, while FIGS. 3B and 3C are front and side views, respectively, depicting the various components of the fastening mechanism 300. As discussed above and as depicted in greater detail by FIG. 3C, fastening mechanism 300 includes a reversable flap portion 310 and a body portion 350 configured be coupled to a backing plate 360.

Figure 3D:
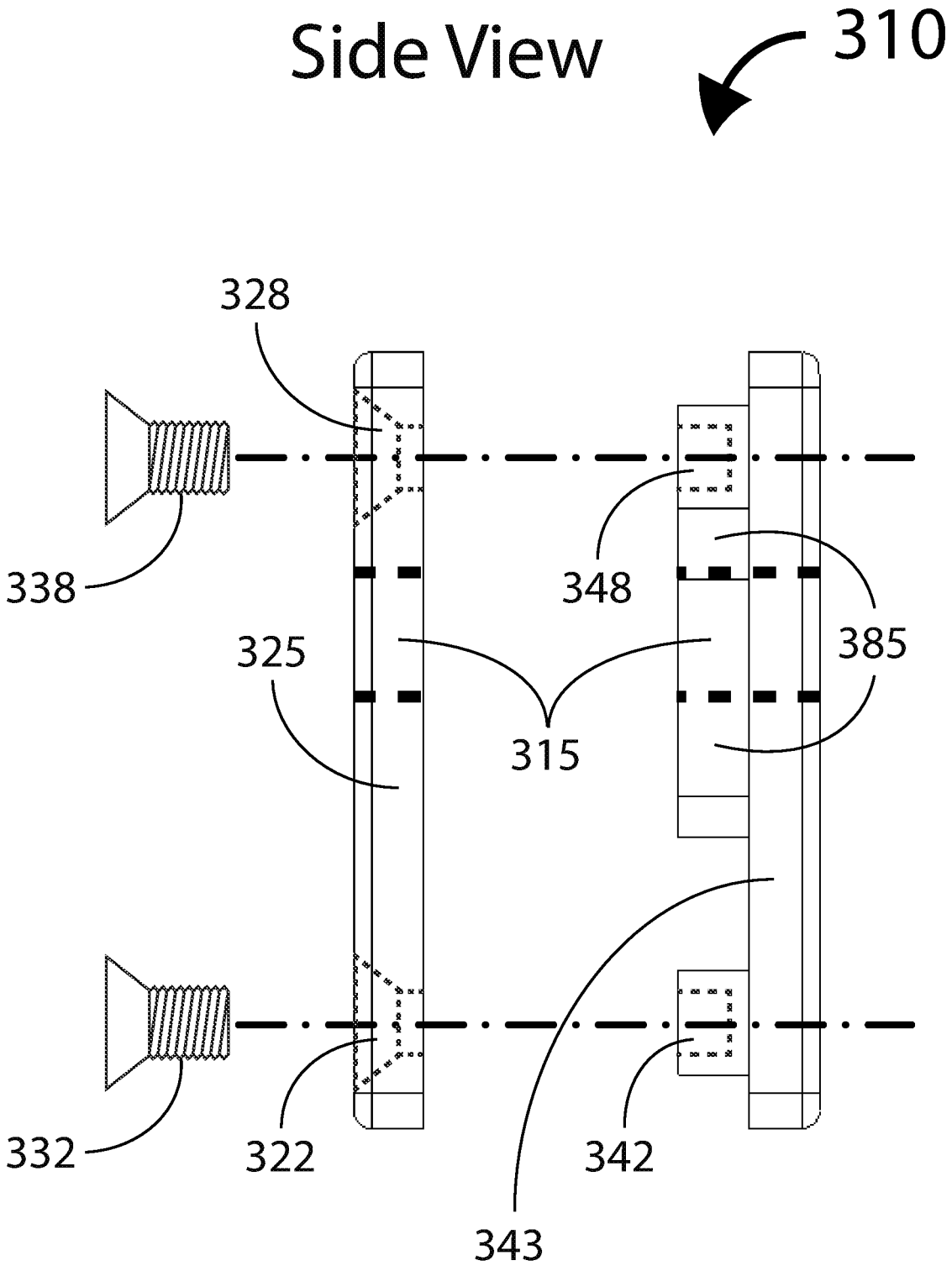
FIG. 3D is an exploded side view depicting components of an exemplary reversible flap portion for the fastening mechanism of FIG. 3A.

Referring again to FIGS. 3B, 3C and also FIG. 3D which is an exploded side view depicting components of the reversible flap portion 310 of fastening mechanism 300, flap portion 310 includes a first plate 325, a second plate 343 and a plurality of screws 332, 334, 336 & 338. Note that, for example, screws 332, 338 are configured to secure plates 325, 343 together, by being inserted into through holes 322, 328 of plate 325, and then into threaded blind holes 342, 348 of plate 343, respectively.

When assembled, reversible flap portion 310 has a channel 315 formed through both plates 325 & 343, the channel 315 configured to engage with a protrusion 355 of the body portion 350 for snugly engaging, for example, leading section 112 of the flap with the first body panel 122.

In some embodiments, a magnet (not shown) is embedded inside a space 385 formed within plates 325, 343 of flap portion 310, the magnet providing a means of attracting and securing flap portion 310 to body portion 350 of fastening mechanism 300.

Figure 3E:
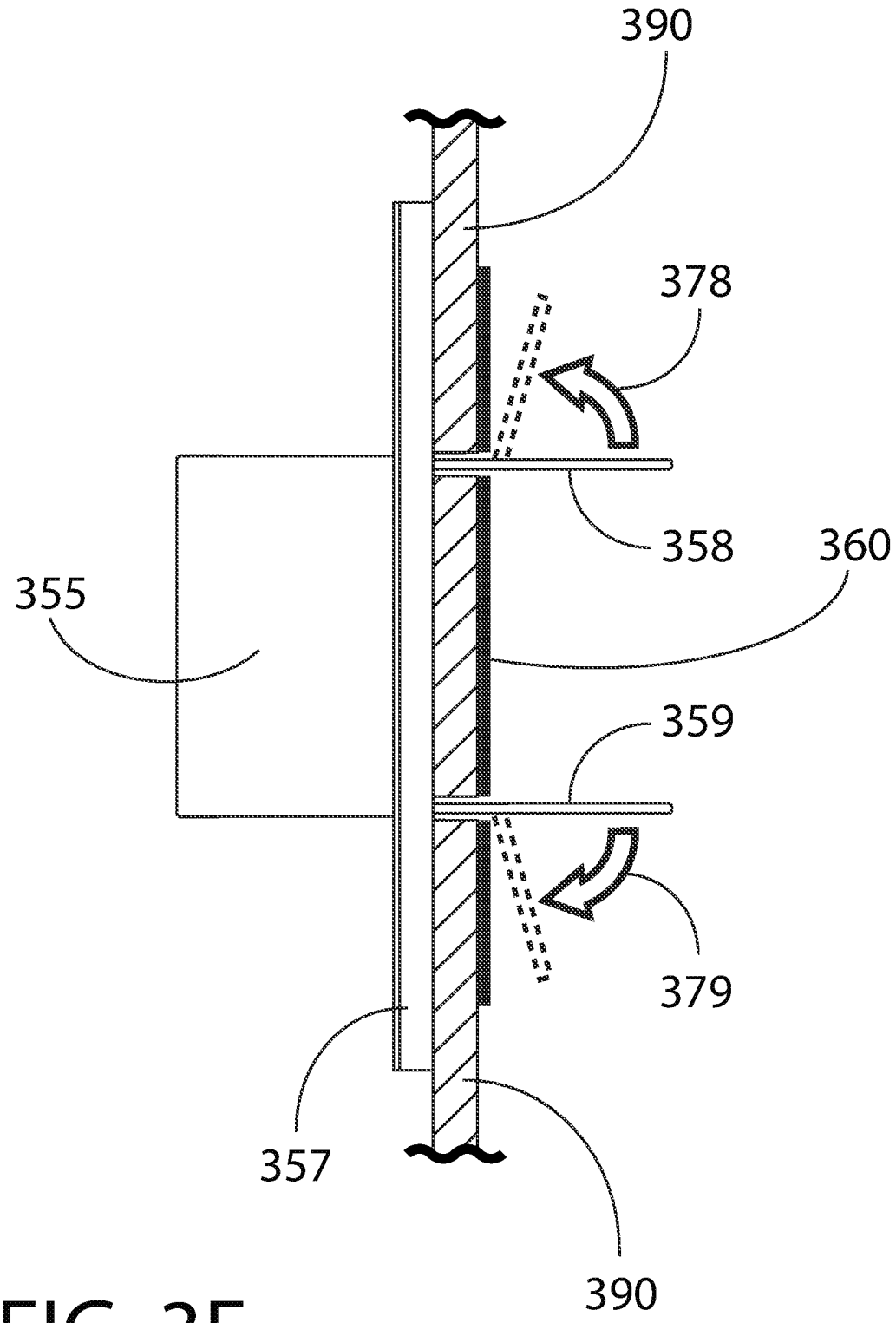
FIG. 3E is a pseudo-cross-sectional top view depicting the components of an exemplary body portion configured to mate with the flap portion of the fastening mechanism of FIG. 3A.

FIG. 3E is pseudo-cross-sectional top view depicting the components of the exemplary body portion 350 of the fastening mechanism 300. Referring also to FIG. 3A, protrusion 355 of body portion 350 is configured to mate with the flap portion 310 of the fastening mechanism 300. In this embodiment, body portion 350 of the fastening mechanism includes a front plate 357 and a pair of bendable legs 358, 359. These legs 358, 359 are intended to be inserted through an exemplary side body panel 390 of a carrying bag, e.g., one of side body panels 122, 128 of bag 100 described above.

The legs 358, 359 of body portion 350 can now be inserted through the backing plate 360, and the legs 358, 359 can be bent away from each other as indicated by curved directional arrows 378, 379, respectively, thereby securing the body portion 350 of the fastening mechanism 300 to the exemplary side body panel 390. Alternatively, the legs can be bent towards each other (not shown).

Figure 1C:
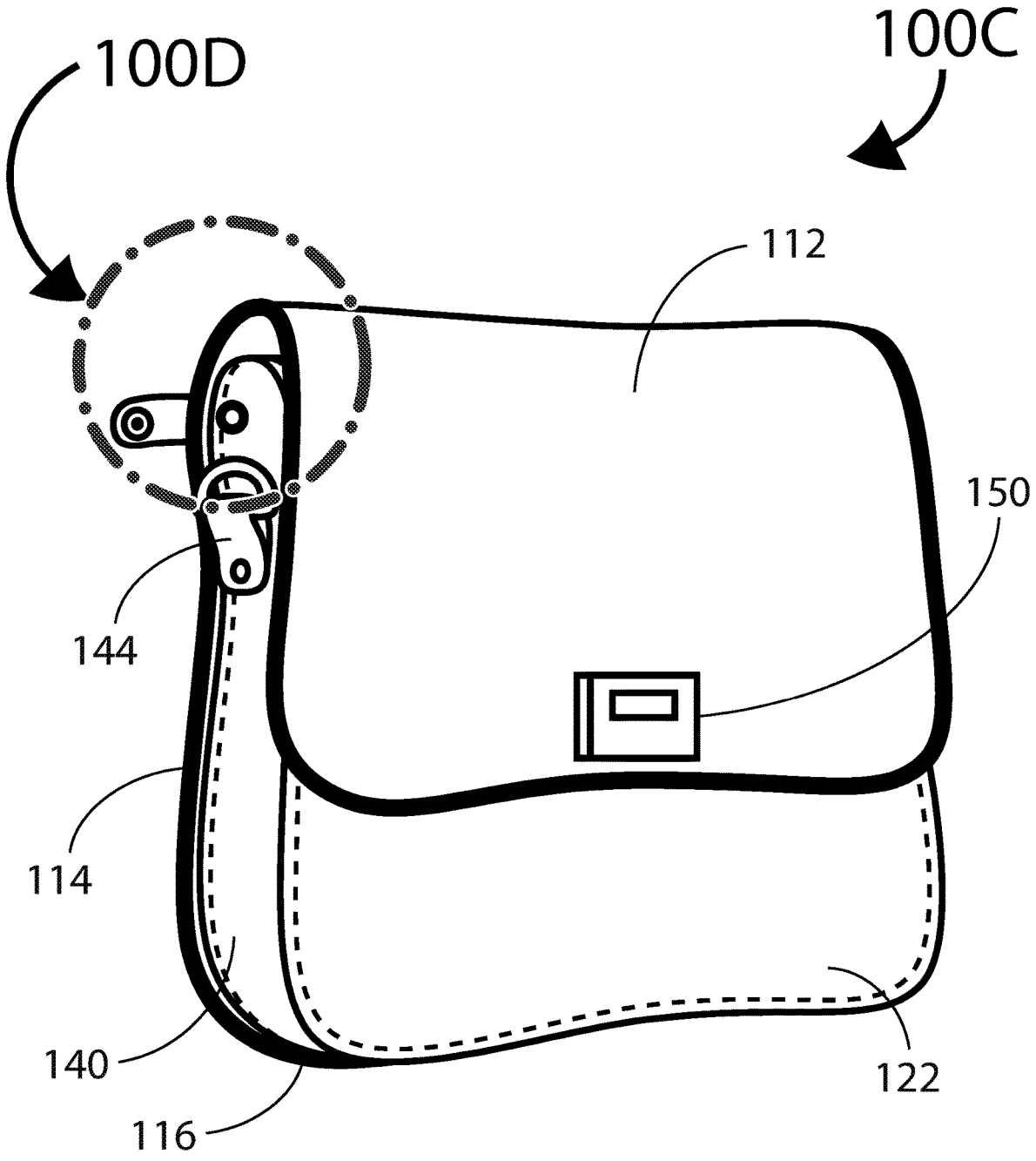
FIGS. 1C-1E illustrates a variant of the embodiment of FIG. 1A with a flap stabilizing mechanism.
Figure 1D:
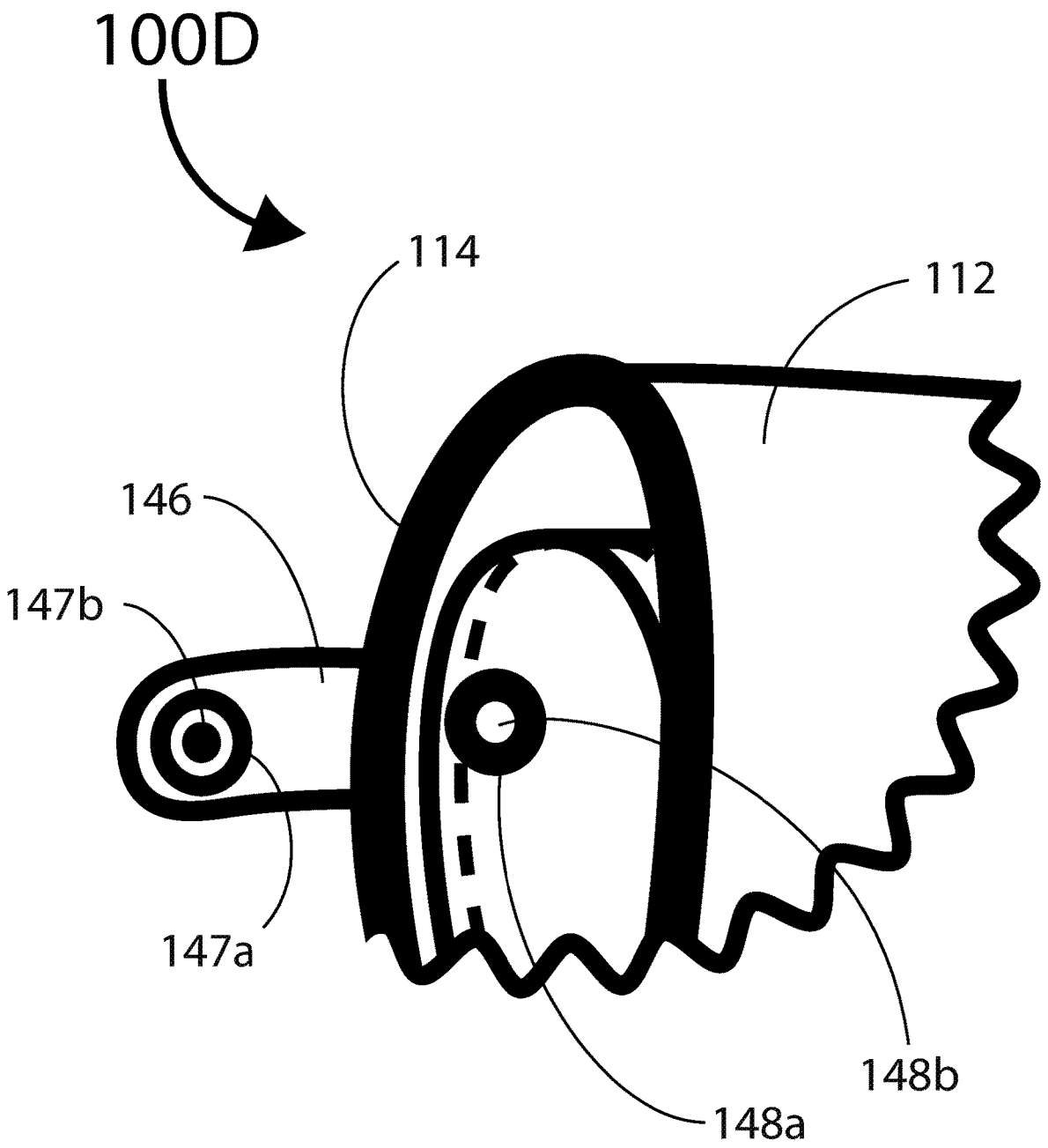
Figure 1E:
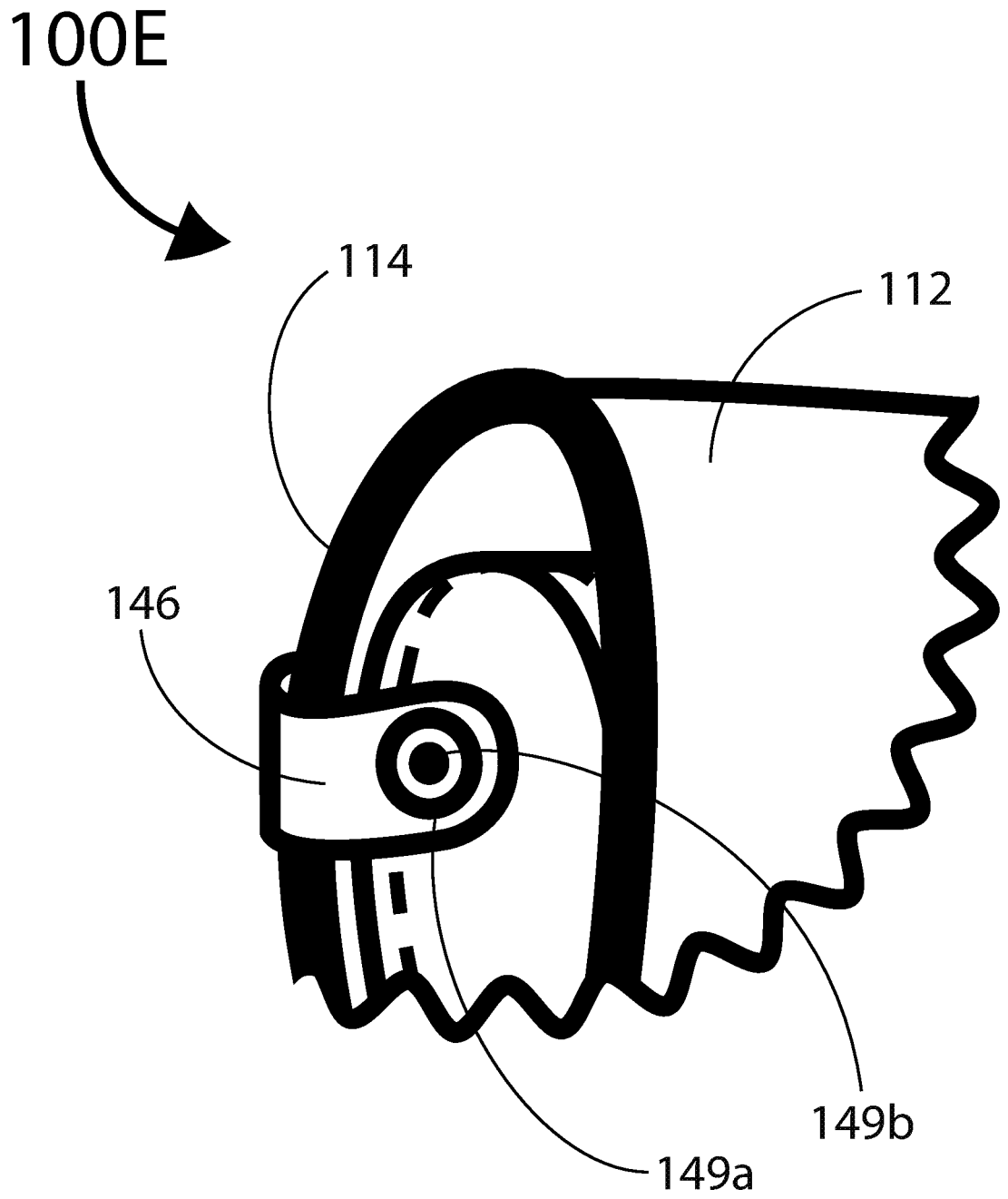

Referring now to FIGS. 1C-1E, an exemplary modified variant bag 100C also includes a flap stabilizing mechanism. In this embodiment, as depicted by denoted area 100D of FIG. 1C, this bag 100C also includes a flap stabilizing mechanism for securing the middle section 114 of the flap to the main body of the bag 100C.

FIG. 1D is a magnified perspective view illustrating in detail the exemplary flap stabilizing mechanism of bag 100C when the middle section 114 of the flap is adjacent to the second side panel 128 of the main body. The stabilizing flap mechanism a short reversible strap 146 with a flap module, e.g., a dual-faced magnetic button with a first flap face 147*a*-147*b* configured to be operatively coupled to one or more corresponding body module(s), e.g., a first body module with a first body face 148*a*-148*b*.

Note that as shown in the magnified perspective view of FIG. 1E, in this variant, when the reversible strap 146 is attached to the main body of bag 100C, i.e., when the first flap face 147*a*-147*b* is engaged to the first body face 148*a*-148*b*, a second flap face 149*a*-149*b*, previously hidden on a flip side of strap 146, is now visible. This second flap face 149*a*-149*b* is intended to be operatively coupled a hidden corresponding second body face (not shown) when the middle section 114 of the flap is adjacent to the first side panel 122 of the main body.

Other permutations of flap stabilizing mechanism for variant bag 100C are also possible. For example, an alternative flap stabilizing mechanism can include a hidden flat magnetic disc located inside a pocket sewn inside middle section 114 of the flap configured to be operatively coupled to one or more corresponding body module(s), i.e., to engage with the first body face 148*a*-148*b*.

Many other modifications and additions to the above described exemplary embodiment(s) are possible. For example, in accordance with another embodiment of the present invention, FIGS. 4A-4D illustrate a modified user-configurable bag 400 having a detachable mechanism 480 configured to accommodate a reversible and user-replaceable flap, thereby providing the user with endless options for dramatically morphing the external appearance of bag 400.

Figure 4C:
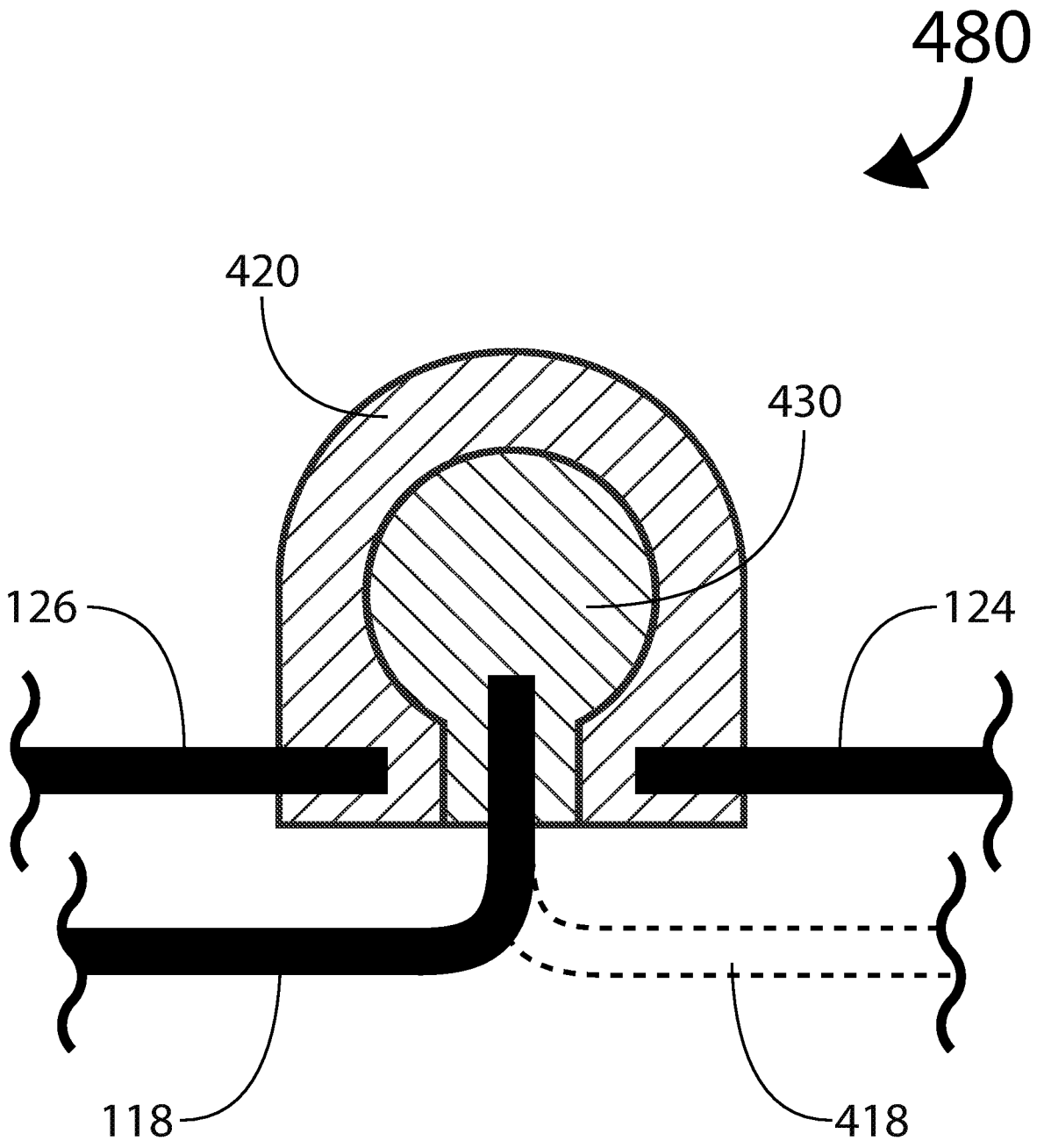
Figure 4D:
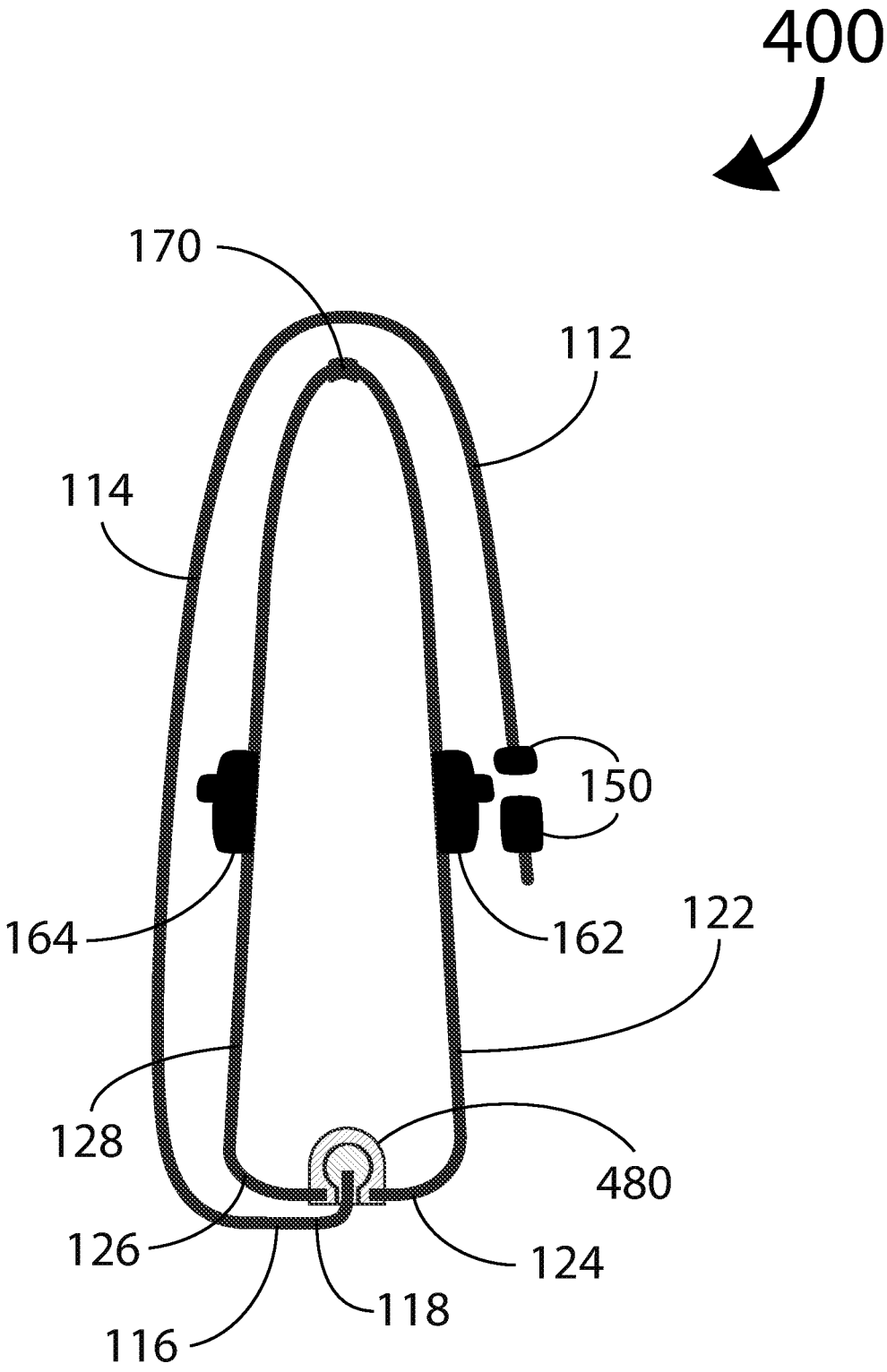

As depicted by the cross-sectional view of FIG. 4D, reversible flap of bag 400 includes a leading section 112, a middle section 114, a bottom section 116 and an end section 118. Bag 400 includes a main body with a first side panel 122, a first bottom panel 124, a second bottom panel 126, a second side panel 128, and a closing mechanism 170. Bag 400 also includes a fastening mechanism with a reversible flap portion 150, a first body portion 162 and a second body portion 164.

As illustrated by FIGS. 4C & 4D, bag 400 functions very similarly to the bag 100 described above, in that bag 400 has a first orientation and a second orientation. In other words, the reversible flap of bag 400 is capable of an orientational reversal resulting in the end section 118 of the flap being relocated to position 418, and wherein an initially inside-facing surface of the flap becomes the outside-facing surface and vice versa. By reversing the orientation of the flap of bag 400, the external appearance of bag 400 can be dramatically morphed to appear very different.

In this embodiment, during assembly of bag 400, the end section 118 of the flap is secured to an elongated insert 430, as shown in FIGS. 4A & 4B. In addition, first bottom panel 124 and second bottom panel 126 of the main body are both secured to a corresponding elongated receiver 420. Depending on the respective materials used for construction of bag 400, the bottom panels 124, 126 and the end section 118 can be securely fastened to the detachable mechanism 480 by suitable joinery technique(s) including stitching, adhesive (s), heat bonding and/or ultrasonic bonding. In accordance with a notable feature of bag 400, the elongated insert 430 is configured to be removable and to be snugly mated with the elongated receiver 420 at will by the user.

Such an arrangement advantageously provides the user with an unlimited ability to quickly replace the reversible flap of bag 400 at will and without tools, thereby resulting in infinite user choices for defining the external appearance of bag 400. Elongated insert 430 and/or elongated receiver 420 can be manufactured as, for example, machined part(s), aluminum extrusion(s), molded polycarbonate part(s), impregnated resin part(s) and/or 3-D printed plastic/metallic part(s).

Figure 5A:
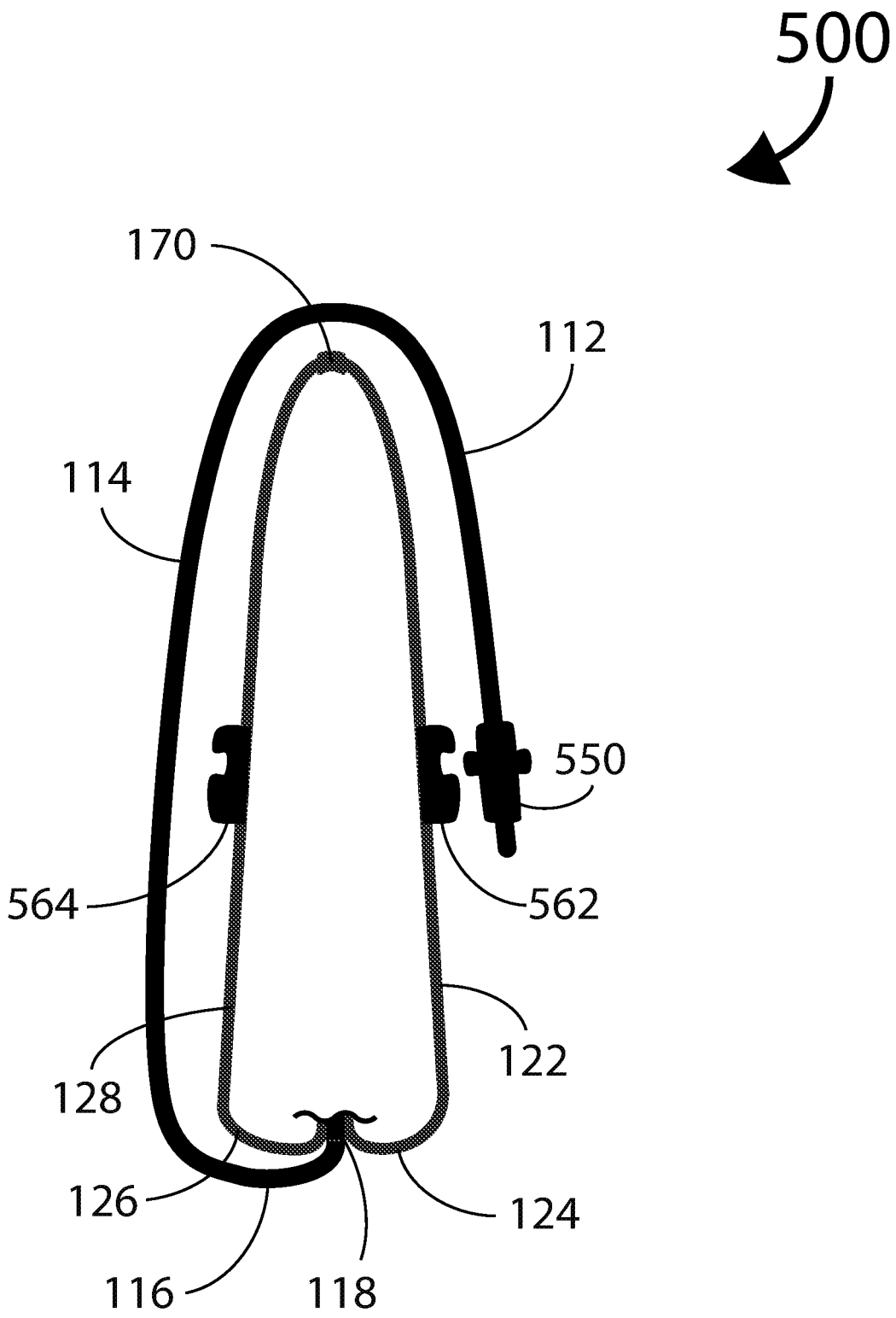
FIGS. 5A and 5B illustrate an additional embodiment of a user configurable bag with a reversible flap, in accordance with the present invention.
Figure 5B:
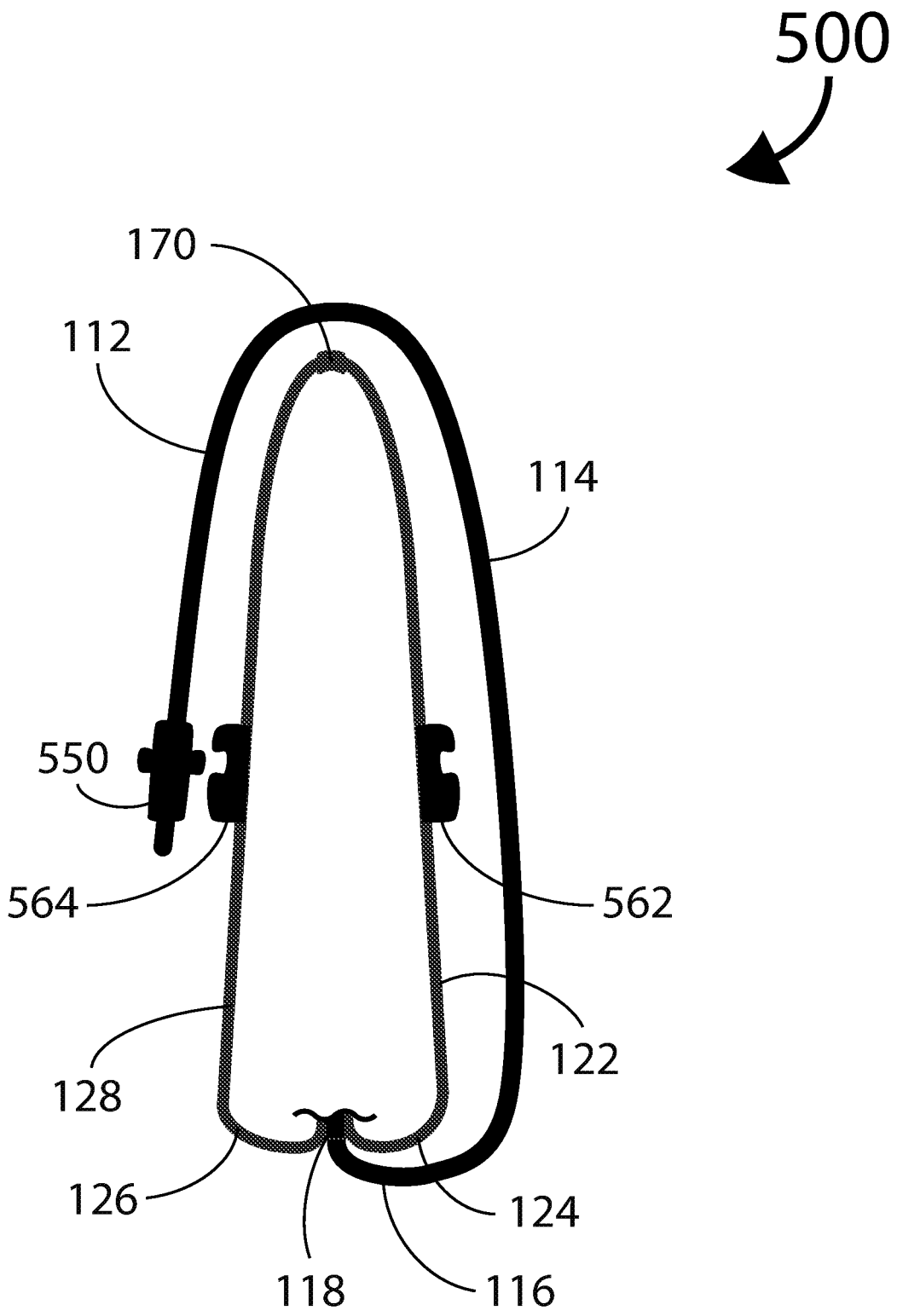

FIGS. 5A and 5B are cross-sectional views of alternate reversible orientations for a user-configurable bag 500 with a reversible flap, in accordance with an additional embodiment of the present invention. Reversible flap of bag 500 includes a leading section 112, a middle section 114, a bottom section 116 and an end section 118. Bag 500 includes a main body with a first side panel 122, a first bottom panel 124, a second bottom panel 126, a second side panel 128, and a closing mechanism 170. Bag 500 also includes a modified fastening mechanism with a reversible flap portion 550, a first body portion 562 and a second body portion 564.

Bag 500 functions very similarly to the bag 100 described above, with FIGS. 5A and 5B depicting a first orientation and a second orientation, respectively, thereby illustrating the transition of the flap of bag 500 during its orientational reversal process, wherein an initially inside-facing surface of the flap becomes the outside-facing surface and vice versa. By reversing the orientation of flap of bag 500, the external appearance of bag 500 can be dramatically morphed, and bag 500 now looks very different.

Figure 6A:
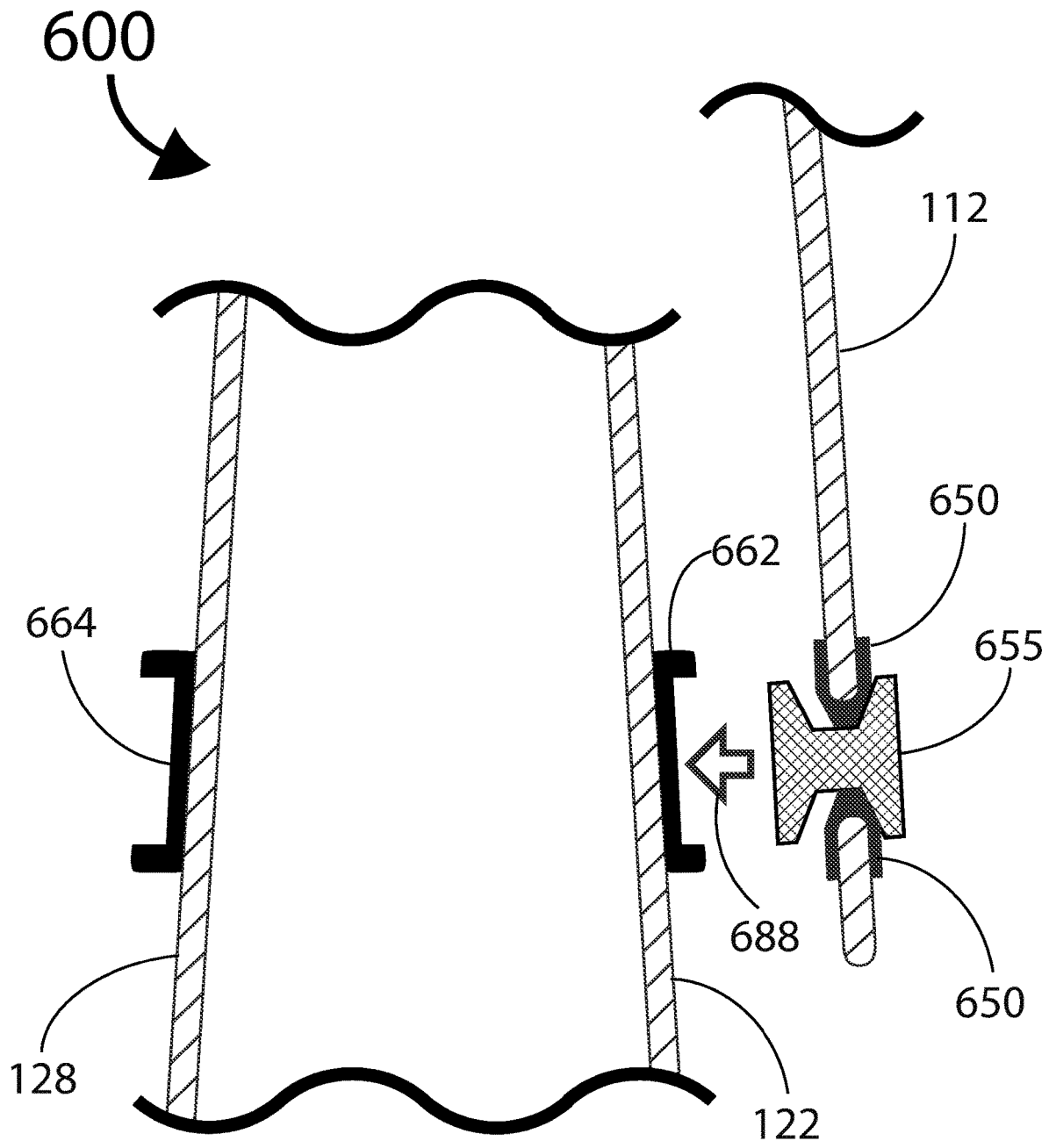
FIGS. 6A and 6B illustrates yet another embodiment of a user configurable bag with a reversible flap, in accordance with the present invention.
Figure 6B:
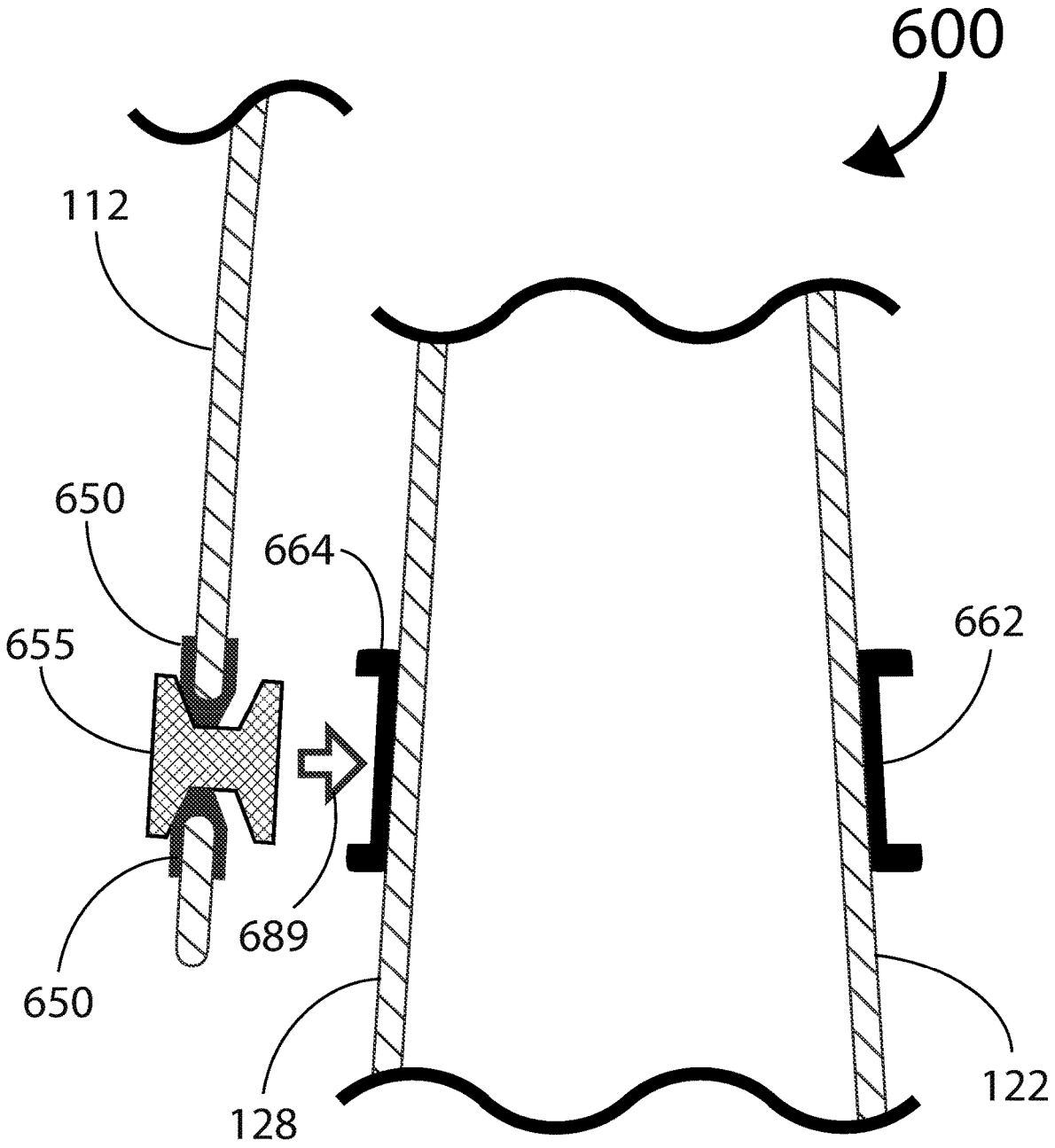

FIGS. 6A and 6B are cross-sectional views illustrating yet another exemplary embodiment of a user-configurable bag 600 with a reversible flap. Like bag 100, the reversible flap of bag 600 includes a leading section 112. Similarly, bag 600 includes a main body with a first side panel 122 and a second side panel 128. Bag 600 functions very similarly to the bag 100 described above, with FIGS. 6A and 6B depicting a first orientation and a second orientation, respectively, thereby illustrating the transition of the flap of bag 600 during its orientational reversal process, wherein an initially inside-facing surface of the flap becomes the outside-facing surface and vice versa. Just like bag 100, by reversing the orientation the flap of bag 600, the external appearance of bag 600 can be dramatically morphed to appear very different.

In this embodiment, bag 600 includes a modified low-profile fastening mechanism having a first body portion 662, a second body portion 664, and a reversible flap portion 650 operatively coupled to a slidable dual-headed magnetic button 655. Depending on the desired orientation, the magnetic button 655 slides freely within the flap portion 650, as indicated by directional arrow 688 or directional arrow 689, to engage with either first body portion 662 or second body portion 664, thereby securing the leading section 112 of the reversible flap to the first side panel 122 or to the second side panel 128, respectively.

In sum, the above described embodiments exemplifies the different features and illustrates the advantages provided by the present invention. By describing the design, assembly and functionality of exemplary highly configurable utility bags, designers and manufacturers are inspired to adopt and/or adapt these techniques to produce user-configurable ladies' handbags and purses. As a result, users are provided with fashionable and user-configurable bags that take up minimal space at optimal costs.

While this invention has been described in terms of several embodiments, there are alterations, modifications, permutations, and substitute equivalents, which fall within the scope of this invention. Although sub-section titles have been provided to aid in the description of the invention, these titles are merely illustrative and are not intended to limit the scope of the present invention. In addition, where claim limitations have been identified, for example, by a numeral or letter, they are not intended to imply any specific sequence.

It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A user-reconfigurable bag comprising:

a main body having a first side panel, a first bottom panel, a second bottom panel, a second side panel, and a pair of end panels;

a reversible bag flap having a leading section, a middle section, a bottom section and an end section, wherein the bag flap has a first orientation and a second orientation, and wherein an initially inside-facing surface of the bag flap in the first orientation transitions to become an outside-facing surface in the second orientation;

a pair of reversible flap stabilizing mechanisms for securing the middle section of the bag flap to the main body of the bag, wherein the pair of reversible flap stabilizing mechanisms comprise a pair of straps that are permanently coupled to opposite sides of the middle section of the bag flap and reversibly coupled to the top of each of the pair of end panels, respectively, by a double sided button on each of the pair of straps, and wherein each of the pair of straps extends between the middle section of the bag flap and their respective end panel in a manner to closely hold the middle section of the bag flap to either the first side panel or the second side panel based upon the orientation, and a fastening mechanism having a reversible flap portion, a first body portion and a second body portion, wherein the flap portion is configured to mate with one of the first body portion and the second body portion.

2. The bag of claim 1 further comprising a closing mechanism configured to secure a top of the first side panel to a corresponding top of the second side panel.

3. The bag of claim 2 wherein the closing mechanism is a zipper.

4. The bag of claim 1 further comprising a carrying strap.

5. The bag of claim 4 wherein the carrying strap is permanently attached.

6. The bag of claim 4 wherein the carrying strap is detachable.

7. The bag of claim 1 wherein each of the first body portion and the second body portion of the fastening mechanism includes a protrusion for engaging the reversible flap portion of the fastening mechanism.

8. The bag of claim 1 the fastening mechanism further comprising a backing plate, and wherein each of the first body portion and the second body portion includes a pair of bendable legs intended to be inserted through a corresponding one of the first side body panel and the second side panel, and then inserted through the backing plate, and wherein the legs are intended to be bent away or toward each other, thereby securing the respective each one of the first body portion and the second body portion to the corresponding each one of the first side body panel and the second side panel.

9. The bag of claim 1 further comprising a detachable flap mechanism and wherein the reversible bag flap is readily detachable by a user without tools.

10. The bag of claim 9 wherein the detachable flap mechanism includes an elongated insert and a corresponding elongate receiver, wherein the end section of the bag flap is secured to the elongated insert, wherein the first bottom panel and second bottom panel of the main body are both secured to the elongated receiver, and wherein the elongated insert is configured to be removably mated with the elongated receiver by the user.

* * * * *